United States Patent [19]

Asada et al.

[11] Patent Number: 4,517,757

[45] Date of Patent: May 21, 1985

[54] ELECTRIC IRON WITH CORD REEL DEVICE

[75] Inventors: Shuji Asada, Neyagawa; Tadamasa Nanbu, Kawanishi, both of Japan

[73] Assignee: Matsushita Electric Industrial Co., Ltd., Osaka, Japan

[21] Appl. No.: 485,467

[22] Filed: Apr. 15, 1983

[30] Foreign Application Priority Data

| | | | |
|---|---|---|---|
| Apr. 16, 1982 | [JP] | Japan | 57-56009[U] |
| Apr. 16, 1982 | [JP] | Japan | 57-56010[U] |
| Jun. 25, 1982 | [JP] | Japan | 57-96089[U] |
| Feb. 8, 1983 | [JP] | Japan | 58-20223 |

[51] Int. Cl.[3] ..... D06F 75/28

[52] U.S. Cl. ..... 38/88; 38/90; 174/135; 191/12.4; 242/107.7

[58] Field of Search ..... 38/88, 90, 82; 219/256, 219/247; 242/107.6, 107.7, 18 R, 25 R; 174/135; 191/12.4; 15/410, 412

[56] References Cited

U.S. PATENT DOCUMENTS

| | | | |
|---|---|---|---|
| 1,153,829 | 9/1915 | Rueckert | 191/12.2 R |
| 2,108,111 | 2/1938 | Ehrlich | 219/256 |
| 2,428,446 | 10/1947 | Beede | 242/107.7 |
| 2,561,382 | 7/1951 | Kistner | 38/88 |
| 2,719,702 | 10/1955 | Brace | 191/12.4 X |
| 2,848,731 | 8/1958 | Tamarin | 191/12.4 X |
| 3,030,485 | 4/1962 | Jepson et al. . | |
| 3,593,442 | 7/1971 | Davidson et al. . | |
| 4,141,438 | 2/1979 | Diem | 191/12.4 |
| 4,340,192 | 7/1982 | Burris | 242/107.6 |

FOREIGN PATENT DOCUMENTS

| | | | |
|---|---|---|---|
| 2444807 | 4/1976 | Fed. Rep. of Germany | 191/12.4 |
| 2745739 | 6/1978 | Fed. Rep. of Germany | 219/256 |
| 2837467 | 3/1980 | Fed. Rep. of Germany | 38/90 |
| 48-28080 | 8/1973 | Japan . | |
| 56-39519 | 9/1981 | Japan . | |
| 274018 | 10/1926 | United Kingdom | 191/12.4 |
| 822104 | 12/1959 | United Kingdom | 38/90 |
| 1206683 | 9/1970 | United Kingdom | 242/107.6 |

*Primary Examiner*—Werner H. Schroeder
*Assistant Examiner*—Andrew M. Falik
*Attorney, Agent, or Firm*—Wenderoth, Lind & Ponack

[57] ABSTRACT

An electric iron is provided with a cord reel device, including a base, a heater, a handle and a cord. The cord reel device includes a cord casing, a drum, a spring member for urging the drum to rotate in a winding direction of the cord, a locking member, and a winding button for causing the drum to rotate in the winding direction of the cord in association with the locking member. The reel device is formed with a transparent portion such that the cord wound around the drum is visible from outside of the cord reel device.

12 Claims, 18 Drawing Figures

ELECTRIC IRON WITH CORD REEL DEVICE

BACKGROUND OF THE INVENTION

1. Field of the Invention

The present invention generally relates to an electric iron including a heater and a cord electrically connected to the heater, in which the cord for supplying electric power to the heater is directly rewound from an electric iron body, and more particularly, to an electric iron provided with a cord reel device compact in size, in which the cord can be easily accommodated in a cord casing mounted on the electric iron when the electric iron is not in use.

2. Description of the Prior Art

Generally, electric irons are provided with cords connected to heaters for heating base portions thereof. For example, U.S. Pat. No. 3,030,485 discloses such an electric iron as referred to above in which an attachment plug to be inserted into a plug socket is fixed to one end of a cord and the electric iron is used, with the electric iron being connected to the plug socket through the cord. Meanwhile, ironing is generally performed by moving the electric iron in an irregular manner such that clothes are pressed on an ironing board having a proper area. The cord of the electric iron is required to have a length sufficient for displacement of the electric iron such that a range of the displacement of the electric iron is not restricted extremely. Generally, the length of the cord of each of the electric irons ranges from 6 to 8 feet.

Conventionally, in electric irons, it has been so arranged that the electric iron is kept in custody after completion of ironing with the cord being folded compactly. However, the known electric irons have such inconveniences that the cord may be damaged due to contact with a portion of the electric iron still having a rather high temperature. Due to such damage to the cord its appearance is ugly. Furthermore, the known electric irons have a disadvantage in that, since the cord is maintained at a predetermined length during ironing, the length of the cord is too long in the case where a small article is ironed, thus reducing working efficiency of the electric iron.

In order to eliminate such a disadvantage as referred to above, for example, U.S. Pat. No. 3,593,442 discloses an electric iron in which the cord is wound around the electric iron body, while Japanese Utility Model Publications No. 28080/1973 (Jikkosho 48-28080) and No. 39519/1981 (Jikkosho 56-39519) disclose an electric iron in which the cord is wound around a drum provided in the electric iron. The prior art electric irons referred to above enable the cord to be accommodated neatly but have been disadvantageous in that, since the cord is required to be wound around the electric iron body or the drum manually, it is time-consuming and troublesome to wind the cord of 6 to 8 feet in length around the electric iron body or the drum completely. Furthermore, the known electric irons have such inconveniences that, since the cord of 6 to 8 feet in length is required to be wound uniformly while correcting kinks produced during ironing, winding of the cord is difficult and a cord casing for accommodating such a cord must be large in size, thus reducing operability of the electric irons.

Moreover, in order to mitigate the drawback of the prior art electric irons associated with manual winding of the cord, German Laid Open Patent Application (Offenlegungsschrift) No. 2,837,467 proposes an electric iron in which a cord reel employing a spring means is provided such that the cord is automatically wound into the cord reel. In comparison with the foregoing prior art electric irons, this known electric iron is an improvement in that the cord can be accommodated easily by simply pressing a button. However, this known electric iron has such a structural inconvenience that the spring means for applying a rotational force to the drum is not coaxial with a rotary shaft of the drum. Furthermore, this known electric iron has such a disadvantage that, since a large space for accommodating the cord is provided therein, the cord casing for accommodating the cord therein is exceedingly large, thereby reducing working efficiency of the electric iron. Since the cord is rewound from the cord casing during ironing, the cord casing which is not required during ironing is secured to a portion adjacent to a handle grip so as to project outwardly from the grip to a large extent, thus reducing operability of the electric iron. Thus, it is concluded that, although this known electric iron is improvement in some respects, this known electric iron is not suitable for practical use.

SUMMARY OF THE INVENTION

Accordingly, an essential object of the present invention is to provide an improved electric iron provided with a compact cord reel device in which a spring means for applying a rotational force to a drum for winding a cord therearound is incorporated such that a cord of 6 to 8 feet in length can be easily and compactly accommodated in a cord casing by automatically winding the cord around a drum through utilization of the rotational force of the spring means without reducing operability of the electric iron and with substantial elimination of the disadvantages inherent in conventional electric irons of this kind.

Another important object of the present invention is to provide an improved electric iron of the above described type in which the cord casing for accommodating the cord therein is formed with a transparent portion such that the cord wound around the drum is visible from outside the cord reel device through the transparent portion so as to enable easy detection of winding malfunctions resulting from the fact that one row of the cord is placed over another.

Still another object of the present invention is to provide an improved electric iron of the above described type in which the spring means for applying the rotational force to the drum for winding the cord therearound is made coaxial with a rotary shaft of the drum and the cord reel device is made more compact in size by disposing the spring means in a recess formed on the drum.

In accomplishing these and other objects according to one preferred embodiment of the present invention, there is provided an improved electric iron provided with a cord reel device, comprising a base having a heater incorporated therein, a handle mounted on said base, and a cord electrically connected to said heater, with said cord reel device being arranged to wind said cord thereinto. The cord reel device further comprises: a cord casing for accommodating said cord therein, which is formed with an outlet for said cord; a drum for winding said cord therearound, which is provided in said cord casing; a spring means for urging said drum to rotate in a winding direction of said cord; an electrical means for electrically connecting said cord to said heater; a locking means for preventing said drum from rotating in the winding direction of said cord; and a winding button which causes said drum to rotate in the winding direction of said cord in association with said locking means; said cord reel device being disposed rearward of said handle and being formed with a transparent portion such that said cord wound around said drum is visible from outside said cord reel device through said transparent portion.

In accordance with the present invention, the cord reel device for accommodating the cord therein has been made compact in size suitable for the electric iron, thus resulting in improvement of working efficiency and operability of the electric iron.

BRIEF DESCRIPTION OF THE DRAWINGS

These and other objects and features of the present invention will become apparent from the following description taken in conjunction with the preferred embodiment thereof with reference to the accompanying drawings.

Before the description of the present invention proceeds, it is to be noted that like parts are designated by like reference numerals throughout several views of the accompanying drawings.

DETAILED DESCRIPTION OF THE PREFERRED EMBODIMENTS

Although the present invention may be applied to any electric iron provided with a cord for supplying electric power to a heater for heating a base, an ordinary steam iron, including a base and a handle according to one preferred embodiment of the present invention, will be described hereinbelow.

Figure 1:
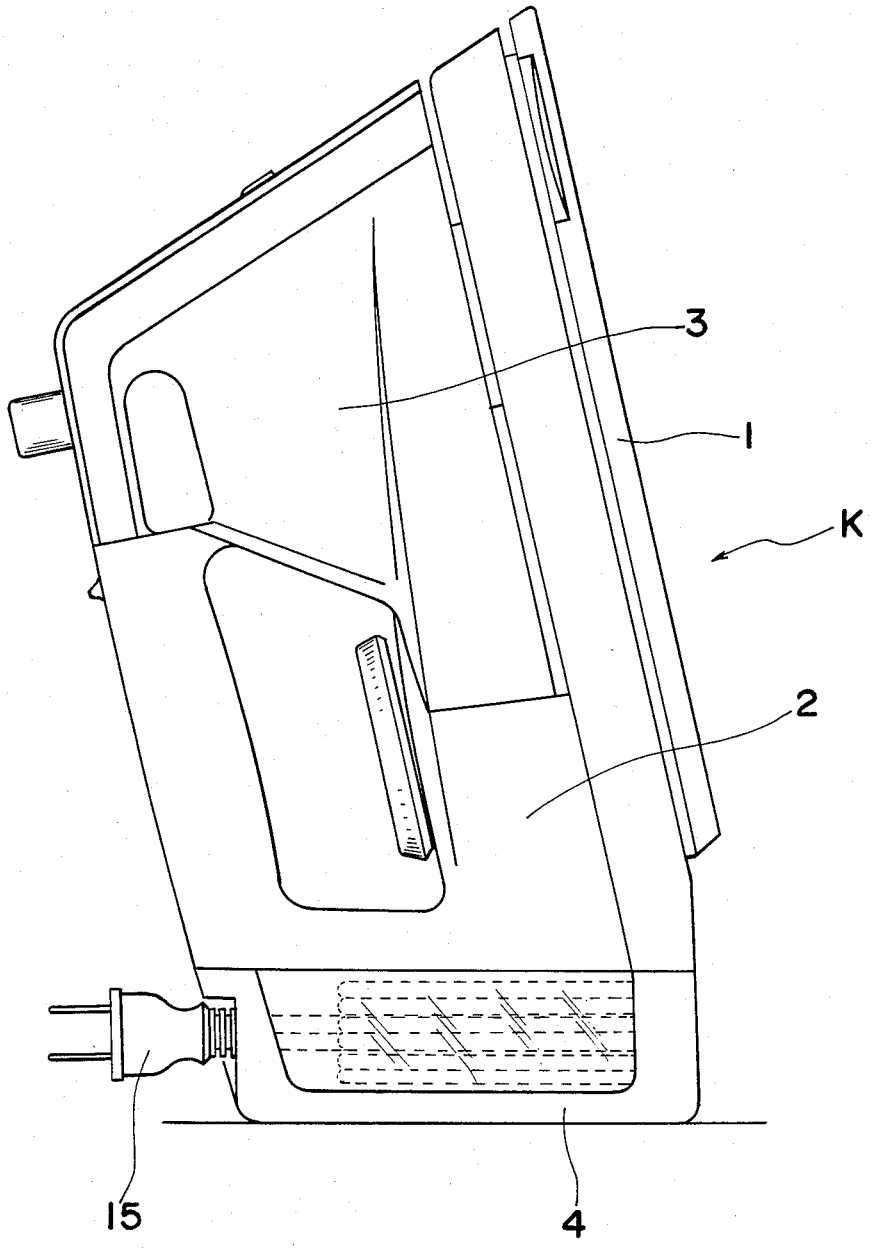
FIG. 1 is a side elevational view of an electric iron provided with a cord reel device, according to one preferred embodiment of the present invention, with the electric iron being disposed in an upright position.

Referring now to the drawings, there is shown in FIGS. 1 to 12, a steam electric iron K according to one preferred embodiment of the present invention. The electric iron K includes a base 1 formed with a plurality of holes (not shown) for discharging steam to a fabric during ironing, a handle 2 mounted on the base 1, a water tank 3 detachably mounted forwardly of the handle 2, and a cord reel device 4 secured to a rear portion of the handle 2. It is to be noted here that all directional indications such as "forwardly", "rearward", "upper", etc. relate to the illustration in FIG. 3. When the electric iron K is placed in an upright position as shown in FIG. 1, a rear face of the cord reel device 4 acts as a supporting face for the electric iron K such that a bottom face of the base 1 is oriented upwardly and obliquely.

Figure 2:
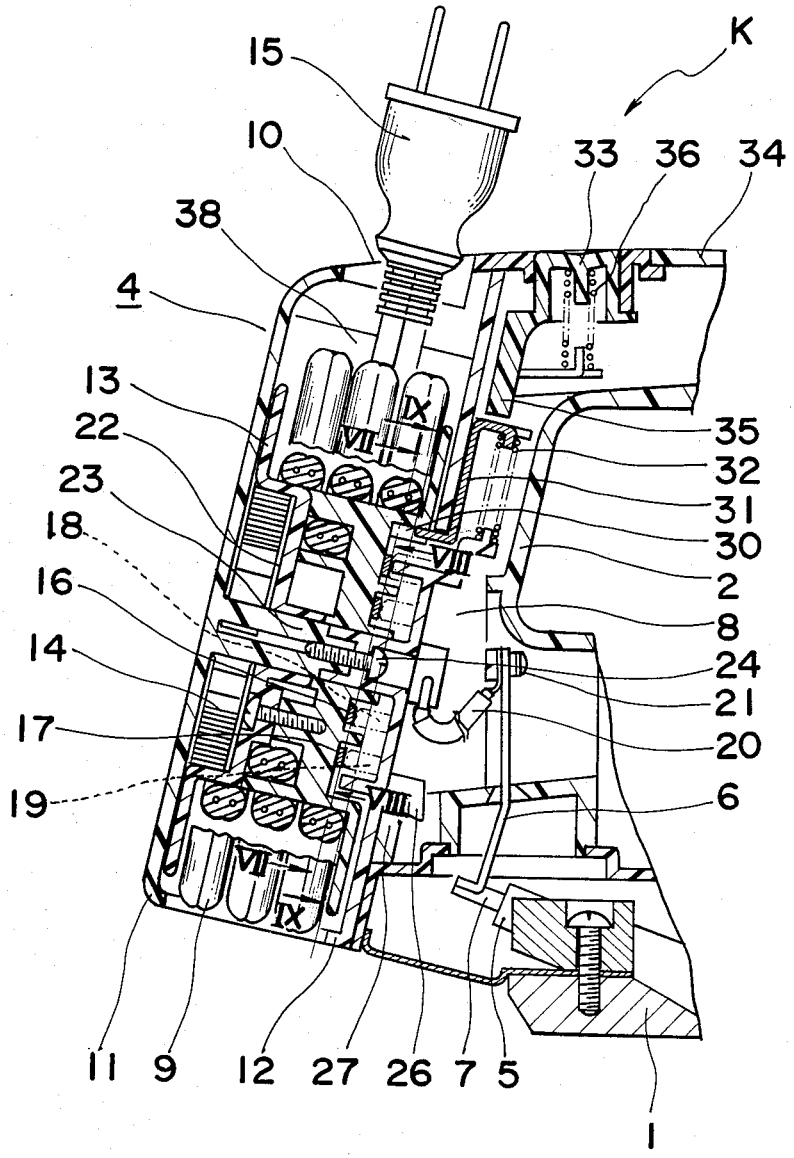
FIG. 2 is a fragmentary cross-sectional view of the electric iron of FIG. 1, particularly showing the cord reel device and a rear portion of a handle employed therein.
Figure 3:
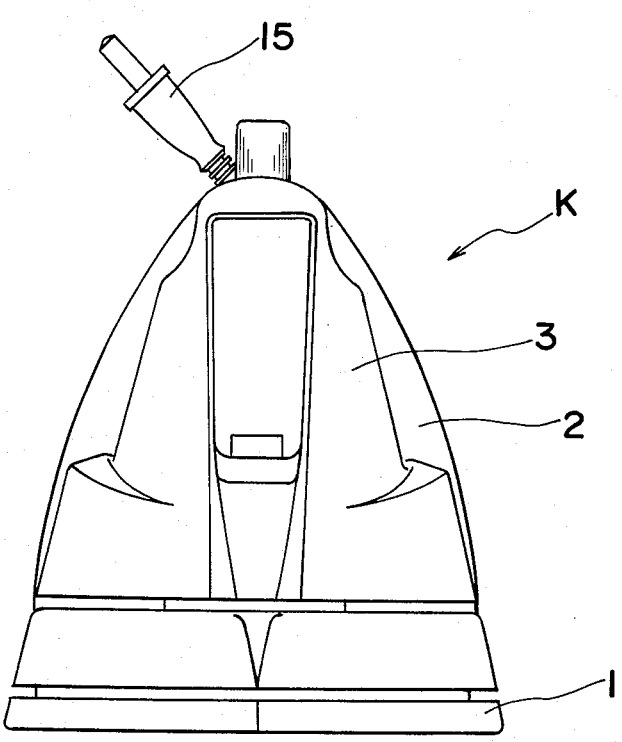
FIG. 3 is a front elevational view of the electric iron of FIG. 1.

As shown in FIG. 2, the base 1 made, for example, of aluminum molding has a U-shaped heater 5 incorporated therein such that opposite ends of the heater 5 are disposed at a rear portion of the base 1. The electric iron K further includes a terminal 7 for the heater 5 and a hollow section 8 formed at a rear portion of the handle 2.

The cord reel device 4 includes an electrically conductive member 6, a cord 9, a pair of cord casings 11 and 12 for accommodating the cord 9 therein, a drum 13 for winding the cord 9 therearound, a spring means 14 constituted by a spiral spring and the like for urging the drum 13 to rotate in a winding direction of the cord 9, electrode plates 16 and 17 having polarities opposite to each other, sliding brushes 18 and 19 confronting the electrode plates 16 and 17, respectively, and an electrical means for electrically connecting the cord 9 to the heater 5. The electrically conductive member 6 is electrically connected to the terminal 7 of the heater 5 such that an upper portion of the electrically conductive member 6 projects into the hollow section 8. The hollow section 8 is defined by walls of the handle 2 such that an opening is formed at a rear face of the handle 2. The cord reel device 4 is secured to the rear face of the handle 2 so as to cover the opening. The pair of the cord casings 11 and 12 has a cord outlet 10 formed at an upper portion thereof such that the drum 13 is provided in the cord casings 11 and 12. It is preferable that the cord 9 is made of an insulating material of rubber having high heat resistance and high flexing resistance such that the cord 9 can be wound and rewound repeatedly over a long period of time. Meanwhile, the cord 9 generally has a length of 6 to 8 feet and has an attachment plug 15 provided at one end thereof. In order to prevent the attachment plug 15 from being inserted into the cord casings 11 and 12, the attachment plug 15 is provided so as to project out of the cord outlet 10. Furthermore, in order to wind the cord 9 of 6 to 8 feet in length around the drum 13 compactly, it is so arranged that the cord 9 is wound around the drum 13 in a plurality of, e.g. 3 or 4 rows. It is preferable that the cord 9 does not have a complete circular cross section but has an elliptic cross section so as to reduce space required for winding of the cord 9. The other end of the cord 9 is fixedly secured to the drum 13.

Figure 7:
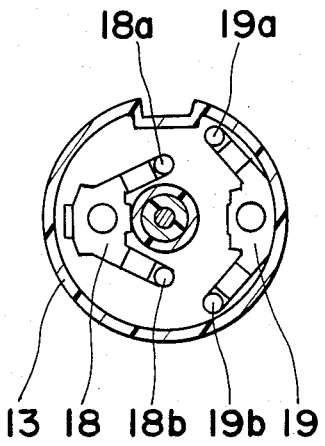
FIG. 7 is a cross-sectional view taken along the line VII—VII in FIG. 2.
Figure 8:
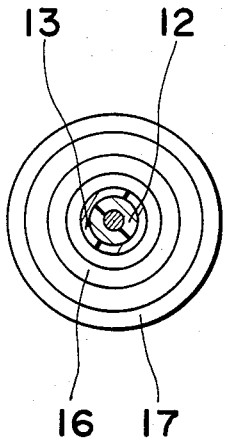
FIG. 8 is a cross-sectional view taken along the line VIII—VIII in FIG. 2.
Figure 9:
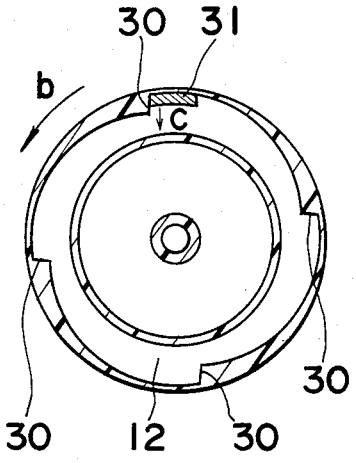
FIG. 9 is a cross-sectional view taken along the line IX—IX in FIG. 2.

As shown in FIG. 8, the electrode plates 16 and 17 are provided in an annular shape and are electrically insulated from each other so as to be connected to the other end of the cord 9. The sliding brushes 18 and 19 of FIG. 7 are attached to the cord casing 12 of FIG. 9 so as to confront the electrode plates 16 and 17 of FIG. 8, respectively, as described above. The sliding brushes 18 and 19 are made of a resilient material so as to be brought into pressing contact with the electrode plates 16 and 17, respectively. The sliding brushes 18 and 19 of FIG. 7 have contacts 18*a* and 18*b* and contacts 19*a* and 19*b*, respectively, such that the electrode plates 16 and 17 are brought into contact with such contacts 18*a* and 18*b* and such contacts 19*a* and 19*b*. Referring again to FIG. 2, a lead wire 20 is secured to the electrically conductive member 6 by the use of a screw 21 so as to electrically connect the sliding brushes 18 and 19 to the electrically conductive member 6. Thus, since the cord 9 is electrically connected to the terminal 7 of the heater 5 through the electrode plates 16 and 17, sliding brushes 18 and 19, lead wire 20 and electrically conductive member 6, electrical connection between the cord 9 and the heater 5 is maintained at all times, even if the cord 9 is rewound to any degree.

The spring means 14 constituted by a spiral spring and the like is disposed between the drum 13 and the cord casing 11. The spring means 14 has an inner end and an outer end engaged with the drum 13 and the cord casing 11, respectively, so as to urge the drum 13 to rotate in a winding direction of the cord 9. The spring means 14 is provided coaxially with a rotary shaft 23 and is formed in a recess 22 in the drum 13 so as to surround the rotary shaft 23. The rear face of the cord casing 11 is disposed adjacent to the drum 13, so that the cord reel device 4 can be made compact in size and the rear face of the cord casing 11 can be used as the supporting face of the electric iron K when the electric iron K is placed in the upright position as shown in FIG. 1.

Figure 4:
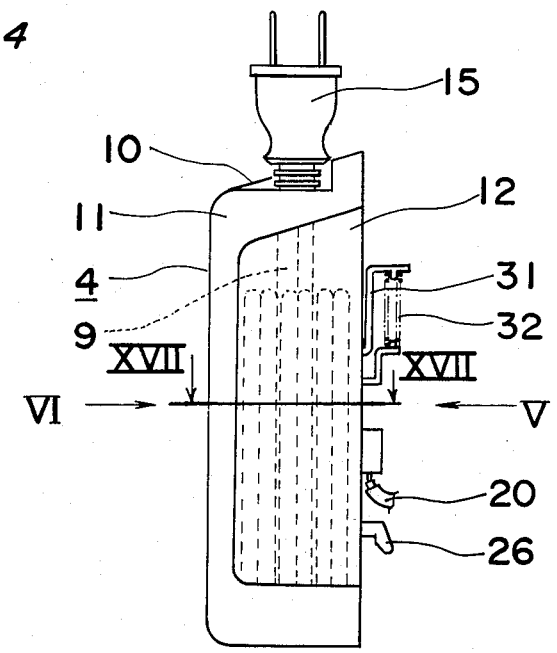
FIG. 4 is a side elevational view of the cord reel device of FIG. 1.
Figure 5:
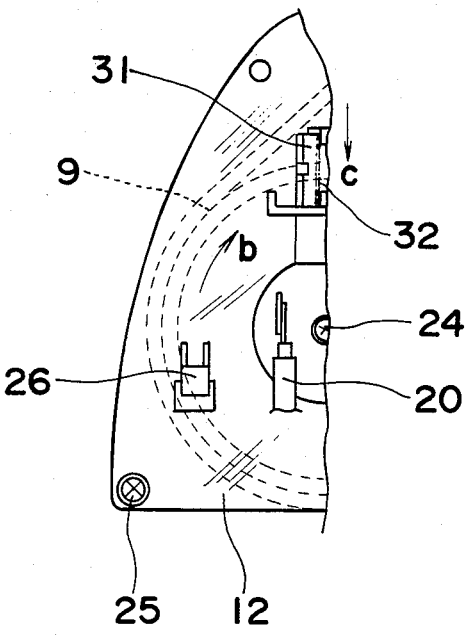
FIG. 5 is a fragmentary view as observed in the direction of the arrow V in FIG. 4.
Figure 10:
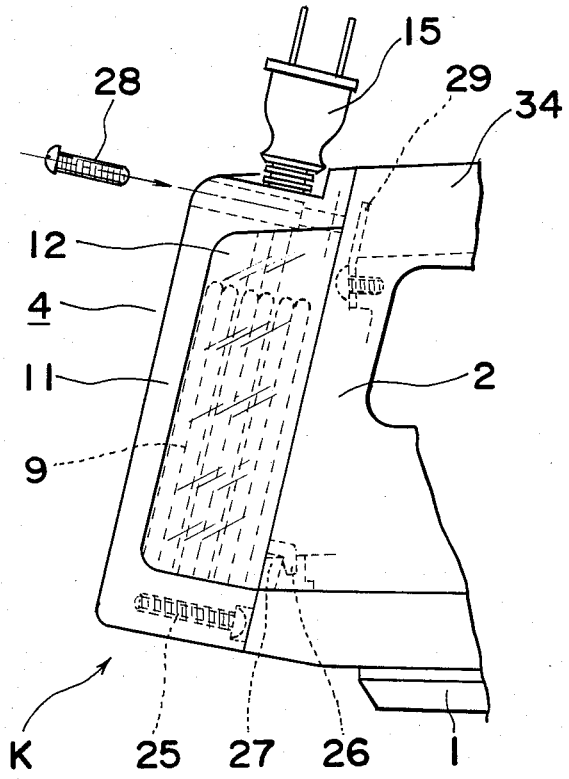
FIG. 10 is a side elevational view of the cord reel device mounted on the rear portion of the handle of the electric iron of FIG. 1.

The pair of the cord casings 11 and 12 are provided so as to accomodate therein the drum 13, the cord 9 wound around the drum 13, the spring means 14, the electrode plates 16 and 17, and the sliding brushes 18 and 19. All these elements are connected to each other by a fastening member 24 provided at the rotary shaft 23. As shown in FIGS. 4 and 5, two fastening members 25 are provided at opposite lower sides of the cord casing 12 so as to form the cord reel device 4 as one unit, with the fastening members 24 and 25 being screws and the like. As shown in FIGS. 5 and 10, it should be noted that the fastening members 24 and 25 are fastened from the side of the cord casing 12 so as to prevent such a phenomenon that, after the cord reel device 4 has been secured to the rear face of the handle 2, the cord reel device 4 is disassembled through inadvertent loosening of the fastening members 24 and 25 with the result that the spring means 14 projects out of the cord reel device 4. The cord casing 12 is disposed adjacent to the handle 2 so as to cover the opening of the hollow section 8 shown in FIG. 2, while the cord casing 11 is made compact in size so as to extend continuously with an outer surface of the handle 2 such that the cord casing 11 does not project out of opposite sides of such handle 2. Furthermore, the cord casings 11 and 12 are molded of thermoplastics such as polycarbonate resin, ABS resin, and the like. The cord casing 11 is made of an opaque material such that the spring means 14, provided between the drum 13 and the cord casing 11, and other components incorporated therein cannot be seen from an outside of the cord casing 11. On the contrary, the cord casing 12 is made of a transparent material so as to extend to opposite sides of the cord casing 11 such that the cord 9 wound around the drum 13 is visible from outside of the cord casing 12, with the cord casing 12 occupying a majority of the opposite sides of the cord casing 11.

An L-shaped projection 26 is provided on the cord casing 12 so as to extend into the hollow section 8 such that the projection 26 is engaged with a brace portion 27 formed on a lower edge of the opening of the hollow section 8. Moreover, as shown in FIG. 10, a screw 28 is provided so as to be screwed into a bracket 29 fixed in the hollow section 8. Accordingly, the cord reel device 4 is secured to the rear face of the handle 2 through engagement of the screw 28 with the bracket 29 and through engagement of the projection 26 with the brace portion 27.

Furthermore, as shown in FIG. 2, the cord reel device 4 includes a plurality of stoppers 30, a locking member 31, a spring 32, and a winding button 33. The stoppers 30 are disposed at one side of the drum 13 adjacent to the handle 2 and are formed on an inner face of a cylindrical portion of the drum 13 coaxially with the rotary shaft 23 so as to allow the drum 13 to rotate only in a rewinding direction of the cord 9. See FIG. 9. As shown in FIG. 2, the locking member 31 is provided at one side of the cord casing 11 adjacent to the handle 2. One end of the locking member 31 is at all times urged substantially in an upward direction by the spring 32 to be disposed at the stoppers 30, while the other end of the locking member 31 is disposed at an upper portion of the hollow section 8 of the handle 2. The winding button 33 is provided at a rear portion of a grip 34 of the handle 2 and is integrally formed with a leg portion 35 extending downwardly toward the locking member 31 into the hollow section 8 such that a distal end of the leg portion 35 is urged in a direction remote from the locking member 31 by a spring 36. It is to be noted that an upper face of the winding button 33 disposed flush with or lower than a surface of the grip 34 such that the winding button 33 is not depressed inadvertently during ironing. Meanwhile, although the winding button 33 is provided on the handle 2 in this embodiment, it can be alternatively so arranged that the winding button 33 is provided on the cord reel device 4 or the winding button 33 for manually operating the locking member 31 is replaced with any other suitable winding member.

Figure 11:
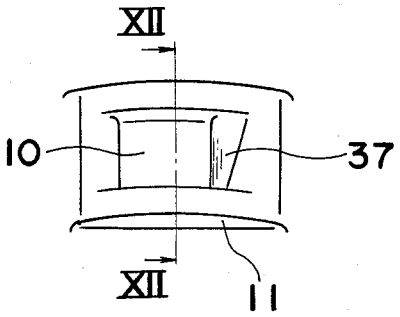
FIG. 11 is a top plan view of an outlet for the cord, formed on the cord reel device of FIG. 1.
Figure 12:
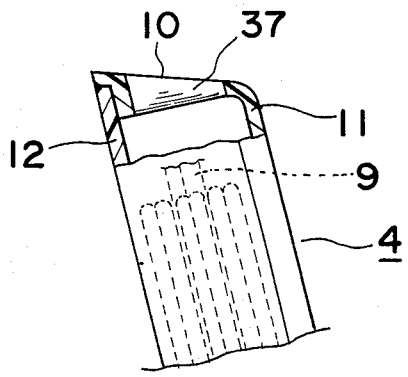
FIG. 12 is a fragmentary cross-sectional view taken along the line XII—XII in FIG. 11.

Referring now to FIGS. 10 to 12, the cord outlet 10 has a guide portion 37 inclined in a direction extending tangentially to a circumference of the drum 13 toward the cord outlet 10 such that the cord 9 can be rewound from the drum 13 smoothly. The cord outlet 10 further has a lower edge extending in parallel with the rotary shaft 23 of the drum 13.

Hereinbelow, operations of the electric iron K provided with the cord reel device 4, according to one preferred embodiment of the present invention, will be described.

When the electric iron K is not in use, the cord 9 is wound around the drum 13 so as to be compactly accommodated in the cord reel device 4 such that only the attachment plug 15 projects out of the cord outlet 10, as shown in FIGS. 1 and 2.

Figure 6:
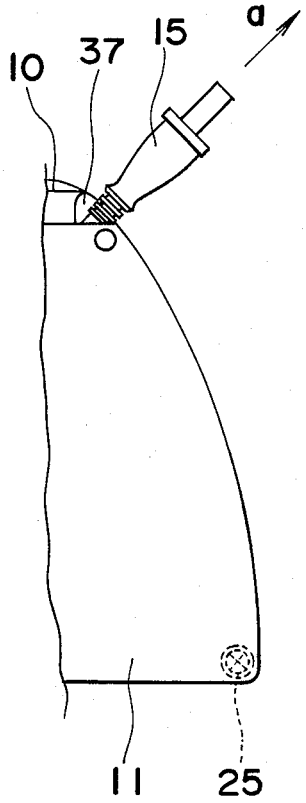
FIG. 6 is a fragmentary view as observed in the direction of the arrow VI in FIG. 4.

In the case where the cord 9 is unwound from the drum 13, a user of the electric iron K is required to pull the attachment plug 15 outwardly in the direction of the arrow a in FIG. 6 by holding the attachment plug 15, whereby the drum 13 is rotated in the direction of the arrow b in FIG. 5 against an urging force of the spring means 14 (FIG. 2). At this time, the cord 9 can be fully unwound from the drum 13. Meanwhile, in the case where the user interrupts unwinding of the cord 9 after the cord 9 has been unwound from the drum 13 to a proper length, one of the stoppers 30 (FIG. 9) is arranged to be engaged with the locking member 31 (FIG. 5), so that the cord 9 is held at the proper length. The user can select any unwinding length of the cord 9 according to sizes of articles to be ironed. More specifically, in the case where the electric iron K is required to be used within a rather small area, it is convenient for easy operation of the electric iron K that the unwound length is small. At this time, it is needless to say that, in the case where the electric iron K is disposed far away from the plug socket, the unwound length of the cord 9 may be large accordingly. In the case where various items having different sizes are ironed and an unwound length for one item is insufficient for another item, the cord 9 can be further unwound up to the overall length of the cord 9 ranging from 6 to 8 feet by pulling the attachment plug 15.

After completion of ironing as shown in FIG. 2, the cord 9 is accommodated in the cord reel device 4 by depressing the winding button 33 provided at the rear portion of the grip 34. At this time, in the case where the user depresses the winding button 33 by one hand while the grip 34 is gripped by the one hand and holds the attachment plug 15 by the other hand, random movements of the attachment plug 15 due to inertia of winding of the cord 9 can be eliminated such that the cord 9 can be smoothly accommodated in the cord reel device 4. It is needless to say that the cord 9 can be accomodated in the cord reel device 4 only by depressing the winding button 33 without holding the attachment plug 15. Furthermore, the winding button 33 can be depressed also when the electric iron K is placed in the upright position as shown in FIG. 1.

Meanwhile, in order to wind the cord 9 into the cord reel device 4 smoothly and rapidly, it is so arranged that the drum 13 is rotated through a proper torque by the spring means 14. When the winding button 33 is depressed as shown in FIG. 2, against an urging force of the spring 36, the locking member 31 is depressed downwardly by the leg portion 35 of the winding button 33 so as to be displaced in the direction of the arrow c in FIGS. 5 and 9 such that the locking member 31 is disengaged from the stoppers 30. Since the drum 13 is at all times urged by the spring means 14 to rotate in the winding direction of the cord 9, i.e. in the direction opposite to the direction of the arrow b in FIG. 5, the drum 13 is rotated in the direction opposite to the direction of the arrow b in FIG. 5 through disengagement of the locking member 31 from the stoppers 30 of FIG. 9, whereby the cord 9 is wound around the drum 13 in multiple rows so as to be accommodated in the cord reel device 4. There is a possibility that, since the cord 9 is wound around the drum 13 irregularly, the cord 9 is not wound around the drum 13 uniformly according to positioning conditions of the electric iron K with the result that one row of the cord 9 is placed over another. However, as shown in FIG. 2, the cord reel device 4 is so arranged that a space 38 defined in the cord casings 11 and 12 has a minimal volume for accommodating the cord 9 compactly therein by winding the cord 9 in multiple rows so as to make the cord reel device 4 compact in size. In the case where one row of the cord 9 is placed over another, a winding diameter of the cord 9 exceeds a permissible limit of the space 38, so that the cord 9 is brought into contact with an inner face of the cord casings 11 and 12, whereby winding of the cord 9 is interrupted. In order to eliminate such a phenomenon as referred to above, conventionally, in electric irons, it has been so arranged that a space in the cord casing is formed sufficiently large in size such that the cord is not brought into contact with an inner face of the cord casing even if the cord is wound around the drum in any state. Accordingly, the known electric irons have such inconveniences that the cord reel becomes extremely large in size and unsuitable for the electric iron. Also stoppage of the winding of the cord is regarded as a malfunction of the cord reel device.

On the other hand, in the electric iron K according to the present invention as shown in FIG. 10, a window formed by a transparent portion of the cord casings 11 and 12 is provided such that the cord 9 wound around the drum 13 is visible from the outside of the cord casings 11 and 12 through the window. Accordingly, even if the above described phenomenon occurs that the cord 9 is wound around the drum 13 in an overlapped manner, the overlap winding of the cord 9 is visble from outside of the cord reel device 4, so that the user does not mistakenly regard stoppages of the winding of the cord 9 as malfunctions of the cord reel device 4. Thus, in the electric iron K, in the case of the overlap winding of the cord 9, the cord 9 is rewound a little and then, the cord 9 is wound around the drum 13 again, whereby the cord 9 is completely accommodated in the cord reel device 4 which has been made very compact in size.

Figure 13:
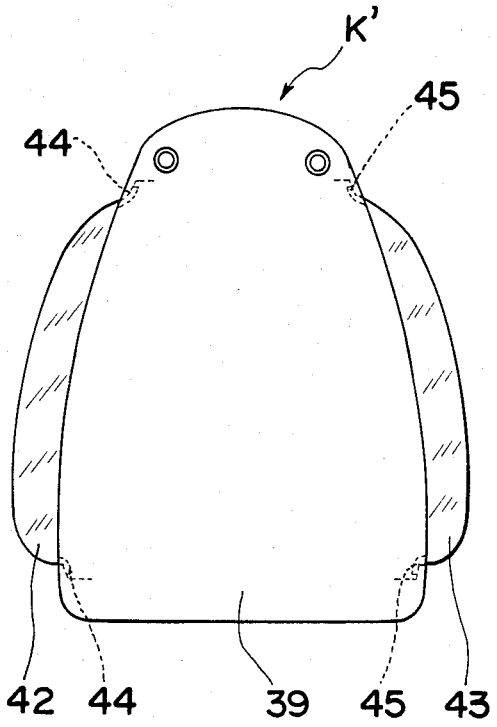
FIG. 13 is a rear elevational view showing a first modification of the electric iron of FIG. 1.
Figure 14:
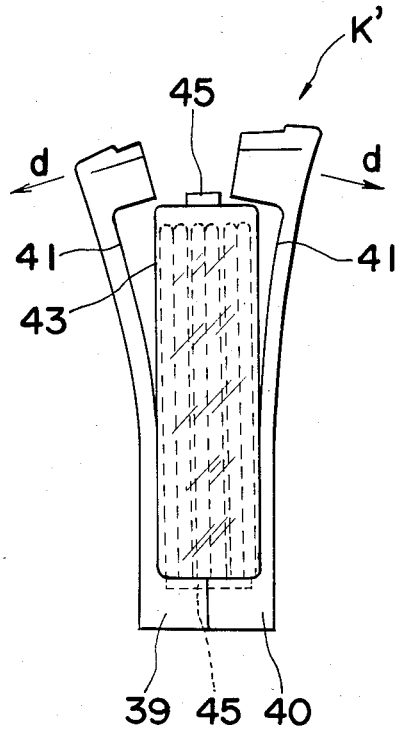
FIG. 14 is a view explanatory of the operation of the electric iron of FIG. 13.

Referring now to FIGS. 13 and 14, there is shown an electric iron K' which is a first modification of the electric iron K. The first modified electric iron K' includes a pair of cord casings 39 and 40 each formed with a recessed portion 41, and a pair of covers 42 and 43 each made of a transparent material. The cord casings 39 and 40 each have the recessed portion 41 formed at a side face thereof such that the recessed portions 41 are covered by the covers 42 and 43, respectively. The cover 42 has a pair of lugs 44 formed at opposite ends thereof, respectively, while the cover 43 has a pair of lugs 45 formed at opposite ends thereof, respectively. Thus, the covers 42 and 43 are secured to the cord casings 39 and 40 by inserting the lugs 44 and 45 into the cord casings 39 and 40. Accordingly, the cord wound around the drum 1 is visible from outside of the cord casings 39 and 40 through the transparent covers 42 and 43. Meanwhile, as shown in FIG. 14, in order to attach the covers 42 and 43 to the cord casings 39 and 40, it is so arranged that, after the spring means has been found so as to urge the drum to rotate in the winding direction of the cord, one end of each of the covers 42 and 43 is engaged with an edge of the recessed portion 41 and then, the cord casings 39 and 40 are pulled apart in opposite directions of the arrows d in FIG. 14 against an elastic force of the cord casings 39 and 40 so as to interpose the other end of each of the covers 42 and 43 therebetween such that other end of each of the covers 42 and 43 is disposed inwardly of the recessed portions 41. Furthermore, the covers 42 and 43 can be replaced by operable covers provided on the cord casings 39 and 40, whereby the overlap winding of the cord can be visually inspected and the cord wound around the drum in the overlap manner can be displaced manually by opening the covers.

Figure 15:
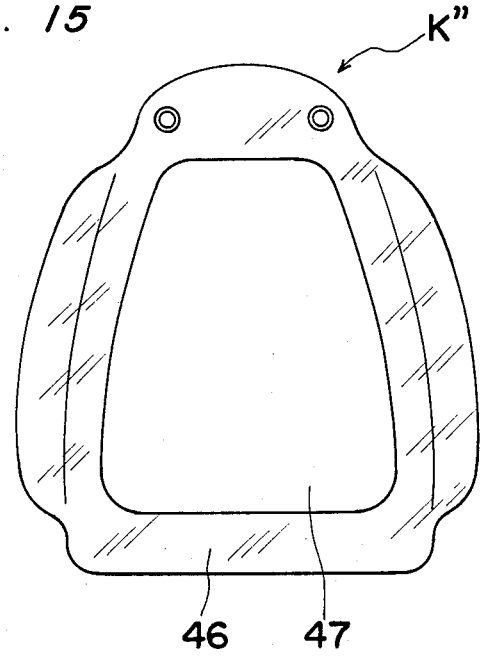
FIG. 15 is a view similar to FIG. 13, particularly showing a second modification of the electric iron of FIG. 1.
Figure 16:
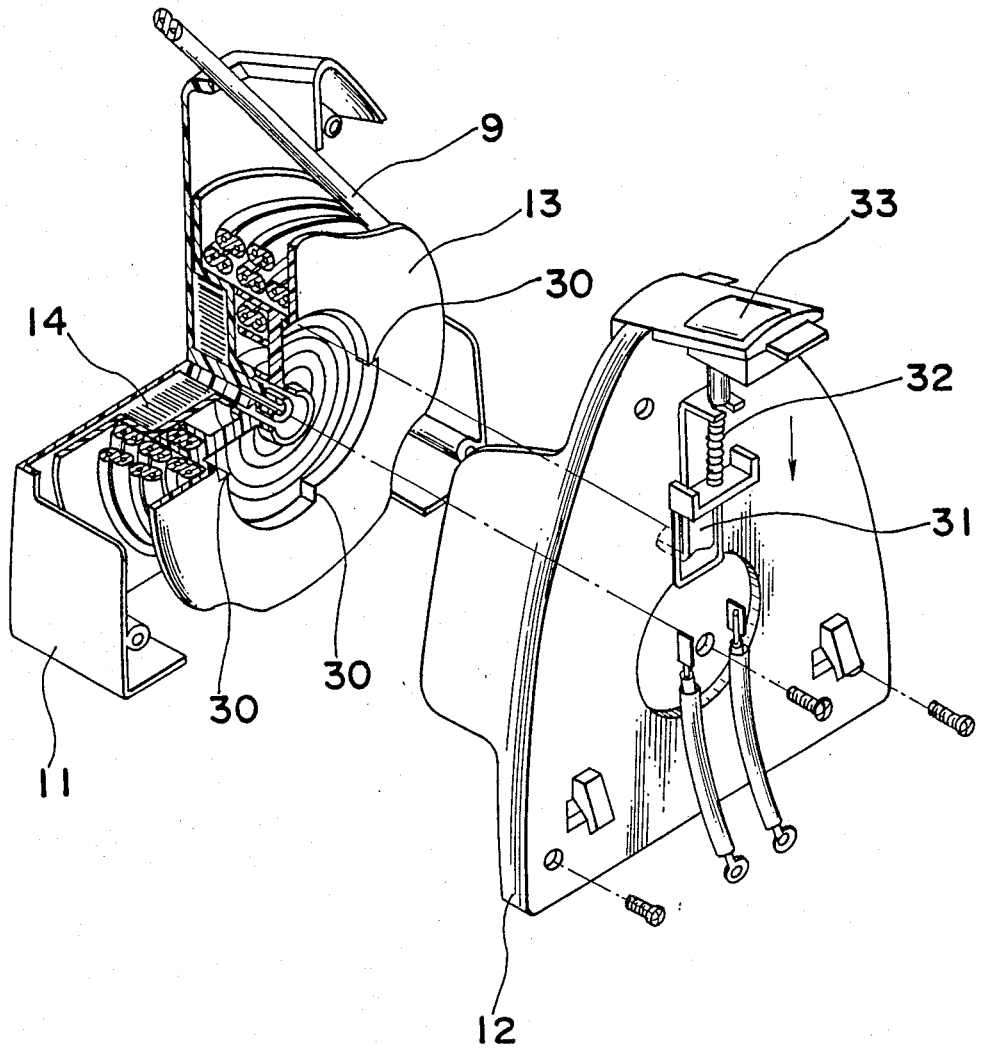
FIG. 16 is an exploded perspective view of the cord reel device of FIG. 2.
Figure 18:
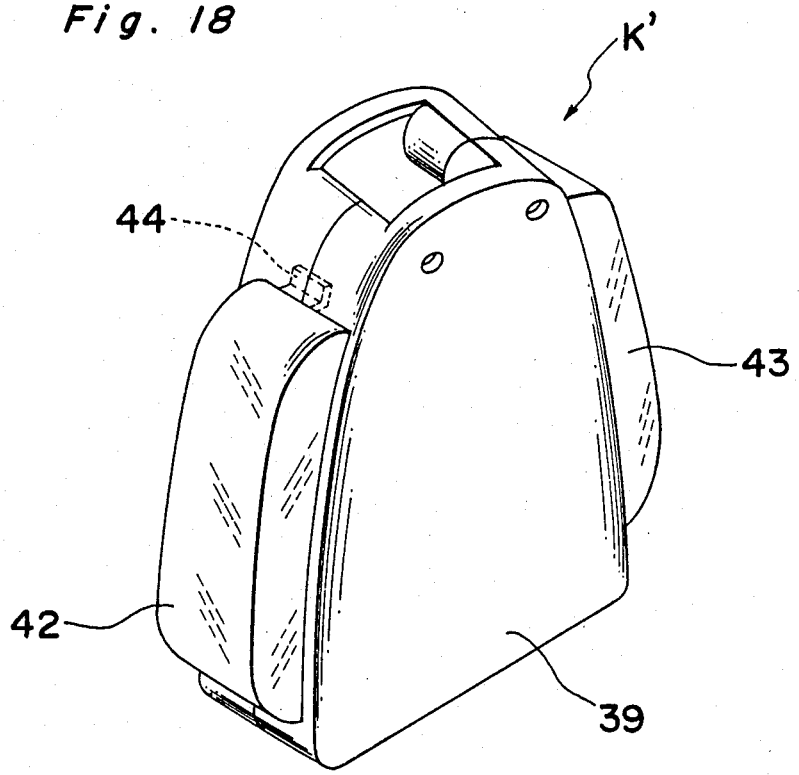
FIG. 18 is a perspective view of the electric iron of FIG. 13.
Figure 17:
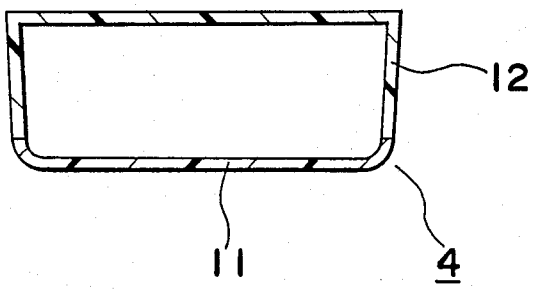
FIG. 17 is a cross-sectional view of a cord casing used in the cord reel device of FIG. 2, as taken along the line XVII—XVII in FIG. 4.

Referring now to FIG. 15, there is shown an electric iron K″ which is a second modification of the electric iron K. The second modified electric iron K″ includes a cord casing 46 and a plate 47. The cord casing 46 is made completely of transparent plastic. In order to improve the commercial value of the electric iron K″, the plate 47 is attached to the cord casing 46 such that the spring means and other components incorporated in the cord casing 46 are invisible from outside of the cord casing 46. Alternatively, it can be so arranged that only one portion of cord casing 46 enabling visual inspection of the cord wound around the drum from the outside of the cord casing 46 is made of the transparent plastic and the remaining portion of the cord casing 46 is made opaque through utilization of conventional processes such as embossing, two-color molding, insert molding, etc.

In the first modified electric iron K′ and the second modified electric iron K″, since the transparent portion is provided so as to surround the cord wound around the drum, it is preferable that the transparent portion serves as the window for the cord most effectively. Furthermore, in the first modified electric iron K′ and the second modified electric iron K″, since projecting portions are also made of a transparent material, such a visual effect is brought about that the cord reel device looks smaller in size than it really is.

Since other constructions of the first modified electric iron K′ and the second modified electric iron K″ are similar to those of the electric iron K, description thereof is shortened for brevity.

As is clear from the foregoing description, in accordance with the present invention, the cord can be adjusted to any length by winding or rewinding the cord, working efficiency for accommodation of the cord is greatly raised through utilization of the cord reel device employing the spring means for automatically winding the cord, and operability of the present invention for ironing is greatly improved.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. An electric iron provided with a cord reel device, comprising a base having a heater incorporated therein, a handle mounted on said base, and a cord electrically connected to said heater, with said cord reel device being arranged to wind said cord thereinto, said cord reel device further comprising:

cord casing means for accommodating said cord therein, said cord casing means having an outlet for said cord;

a drum means for winding said cord therearound, said drum means being provided in said cord casing means;

a spring means for urging said drum means to rotate in a winding direction of said cord;

an electrical means for electrically connecting said cord to said heater;

a locking means for preventing said drum means from rotating in the winding direction of said cord;

a winding button means for causing said drum means to rotate in the winding direction of said cord in association with said locking means, said winding button means being provided flush with or lower than a surface of said handle;

said core reel device being disposed rearward of said handle and having a transparent portion in the cord casing means, such that said cord wound around said drum means is visible from outside of said cord reel device through said transparent portion;

a plurality of fastening members;

said cord casing means having a pair of first cord casing member and a second cord casing member rotatably supporting said drum means from opposite sides thereof;

said first cord casing member and said second cord casing member being secured to each other by said plurality of fastening members;

some of said plurality of fastening members being contained completely within the cord reel device; and at least one other of said plurality of fastening members being directed inwardly and being fixed beneath an outer surface of the first cord casing member for securing said first cord casing member and said second cord casing member to a rear face of said handle;

whereby, after the cord reel device has been secured to the rear face of the handle, the cord reel device is prevented from being disassembled through inadvertent loosening of the plurality of fastening members.

2. An electric iron as claimed in claim 1, wherein said cord casing means has a side face confronting said cord wound around said drum means, said side face being transparent.

3. An electric iron as claimed in claim 1, wherein said cord casing means is constituted by a pair of a first cord casing member and a second cord casing member such that said drum means is rotatably supported from opposite sides thereof by said first cord casing and said second cord casing member, with either one of said first cord casing member and said second cord casing member being transparent.

4. An electric iron as claimed in claim 1, further comprising:

an opaque member;

said cord casing means being made of a transparent material such that said opaque member is provided on a portion of said cord casing means.

5. An electric iron as claimed in claim 1, wherein said drum means has a rotary shaft such that said spring means is provided coaxially with said rotary shaft.

6. An electric iron as claimed in claim 5, wherein said drum means has a recess such that said spring means is disposed in said recess.

7. An electric iron as claimed in claim 5, further comprising:

a guide member, said outlet in said cord casing means for said cord having a lower edge portion extending parallel with the rotary shaft of said drum means, said guide member being inclined from said lower edge portion toward said outlet.

8. An electric iron as claimed in claim 1, wherein said handle has a grip such that said winding button means is disposed adjacent to said grip.

9. An electric iron provided with a cord reel device, comprising a base having a heater incorporated therein, a handle mounted on said base, and a cord electrically connected to said heater, with said cord reel device being arranged to wind said cord thereinto, said cord reel device further comprising:

cord casing means for accommodating said cord therein, said cord casing means having an outlet for said cord;

a drum means for winding said cord therearound, said drum means being provided in said cord casing means;

a spring means for urging said drum means to rotate in a winding direction of said cord;

an electrical means for electrically connecting said cord to said heater;

a locking means for preventing said drum means from rotating in the winding direction of said cord;

a winding button means for causing said drum means to rotate in the winding direction of said cord in association with said locking means;

said cord reel device being disposed rearward of said handle and having a transparent portion in the cord casing means such that said cord wound around said drum means is visible from outside of said cord reel device through said transparent portion;

said cord casing means having a side face confronting said cord wound around said drum means, said side face being formed with an opening, means, being attached to said opening, for covering said opening;

a plurality of fastening members;

said cord casing means having a part of a first cord casing member and a second cord casing member rotatably supporting said drum means from opposite sides thereof;

said first cord casing member and said plurality of casing member being secured to each other by said plurality of fastening members;

some of said plurality of fastening members being contained completely within the cord reel device; and at least one other of said plurality of fastening members being directed inwardly and being fixed beneath an outer surface of the first cord casing member for securing said first cord casing member and said second cord casing member to a rear face of said handle;

whereby, after the cord reel device has been secured to the rear face of the handle, the cord reel device is prevented from being disassembled through inadvertent loosening of the plurality of fastening members.

10. An electric iron as claimed in claim 9, wherein said covering means is detachably or openably attached to said opening.

11. An electric iron as claimed in claim 9, wherein said covering means is made of a transparent material.

12. An electric iron as claimed in claim 9, wherein said covering means is provided so as to project outwardly from an outer periphery of said cord casing means.

* * * * *